US006922865B1

(12) United States Patent
Logan, Sr.

(10) Patent No.: US 6,922,865 B1
(45) Date of Patent: Aug. 2, 2005

(54) TOILET SCRUBBER

(76) Inventor: Audley Logan, Sr., 1021 Meadow Creek Dr., Lancaster, TX (US) 75146

( * ) Notice: Subject to any disclaimer, the term of this patent is extended or adjusted under 35 U.S.C. 154(b) by 0 days.

(21) Appl. No.: 10/772,966

(22) Filed: Feb. 5, 2004

(51) Int. Cl.[7] ..... A47K 11/10

(52) U.S. Cl. ..... 15/114; 15/160; 15/210.1; 15/244.1; D4/132; D32/42; D32/51

(58) Field of Search ..... 15/114, 118, 160, 15/164, 210.1, 211, 244.1; D4/130, 132; D32/40, 42, 51, 52

(56) References Cited

U.S. PATENT DOCUMENTS

| | | | | | |
|---|---|---|---|---|---|
| 725,843 | A | * | 4/1903 | Henn, Jr. | 15/160 |
| 1,700,209 | A | * | 1/1929 | Henn, Jr. | 15/211 |
| 4,033,650 | A | | 7/1977 | Alissandratos | |
| D247,212 | S | | 2/1978 | Welch | |
| 4,216,553 | A | | 8/1980 | Haberle | |
| D266,035 | S | | 9/1982 | Thompson | |
| D272,874 | S | | 3/1984 | Cohen | |
| 4,466,152 | A | | 8/1984 | Moss et al. | |
| D281,743 | S | | 12/1985 | Thompson | |
| 4,724,563 | A | | 2/1988 | Fry et al. | |
| D297,292 | S | | 8/1988 | Plymale | |
| 4,846,599 | A | * | 7/1989 | Seddon | 401/202 |
| D308,443 | S | | 6/1990 | Vetter | |
| 4,967,441 | A | | 11/1990 | White | |
| D318,955 | S | | 8/1991 | Brown | |
| 5,116,151 | A | * | 5/1992 | Lytton et al. | 401/9 |
| 5,259,406 | A | | 11/1993 | Hofmann | |
| 5,440,775 | A | | 8/1995 | Banks | |
| D367,174 | S | | 2/1996 | Matossian | |
| D403,165 | S | | 12/1998 | Ferrante et al. | |
| D404,924 | S | | 2/1999 | Schmidt | |
| 5,941,379 | A | | 8/1999 | Barardo | |
| 5,984,555 | A | | 11/1999 | Samad | |
| D419,019 | S | | 1/2000 | Shafik | |
| 6,108,847 | A | | 8/2000 | Cueman et al. | |
| 6,134,738 | A | | 10/2000 | Weber et al. | |
| D433,819 | S | * | 11/2000 | Thunderchild | D4/132 |
| D433,859 | S | | 11/2000 | Fiegl et al. | |
| 6,154,913 | A | | 12/2000 | Burton | |
| D446,671 | S | | 8/2001 | Thurston-Chartraw | |
| D448,176 | S | | 9/2001 | Petner | |
| D453,888 | S | | 2/2002 | Gottwald | |
| D464,515 | S | | 10/2002 | Katz et al. | |
| D465,957 | S | | 11/2002 | Driscoll et al. | |
| D468,112 | S | | 1/2003 | Libman et al. | |
| D468,539 | S | | 1/2003 | Petner | |
| 6,763,545 | B2 | * | 7/2004 | Silvers et al. | 15/106 |

FOREIGN PATENT DOCUMENTS

| | | | |
|---|---|---|---|
| DE | 2645188 | * | 4/1978 |
| JP | 2003-164392 | * | 6/2003 |

OTHER PUBLICATIONS

Derwent Acc No. 2001–042026, Jun. 2001.*

* cited by examiner

*Primary Examiner*—Mark Spisich
(74) *Attorney, Agent, or Firm*—Munsch Hardt Kopf & Harr, P.C.

(57) ABSTRACT

A cleaning tool comprises a scrubber head having an upper arm, a lower arm, and a connecting member coupling the upper and lower arms. A scrubbing material is secured to an inner surface of the scrubber head.

1 Claim, 2 Drawing Sheets

TOILET SCRUBBER

TECHNICAL FIELD

The present invention relates generally to the field of cleaning tools and more particularly to a toilet scrubber.

BACKGROUND

Although cleaning the toilet probably ranks as the least favorite chore for many, it is a necessary housekeeping task for sanitary reasons and to minimize unpleasant odors. The service surfaces of the toilet fall on many different planes and create areas that are difficult to reach with conventional toilet brushes. In particular, the areas under and behind the overhanging rim of the toilet bowl often accumulate grime and hard water deposits and become discolored. The inside and top surfaces of the toilet rim also become soiled and require scrubbing. Conventional toilet brushes and other implements are not configured to address these different surface areas.

SUMMARY

In accordance with an embodiment, a cleaning tool comprises a scrubber head having an upper arm, a lower arm, and a connecting member coupling the upper and lower arms. A scrubbing material is secured to an inner surface of the scrubber head.

In accordance with another embodiment, a toilet cleaning tool comprises a generally C-shaped scrubber head having an inner surface, and a scrubbing material releasably attached to the inner surface of the C-shaped scrubber head operable to scrub multiple surfaces of a toilet bowl rim substantially simultaneously.

In accordance with yet another embodiment, a cleaning tool comprises a generally C-shaped scrubber head having an upper arm, a lower arm, and a connecting member coupling the upper and lower arms, the upper arm, lower arm and connecting member having an inner surface. A scrubbing material is releasably attached to the inner surface of the upper arm, lower arm and connecting member, and an elongated handle is coupled to the scrubber head.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

Figure 1:
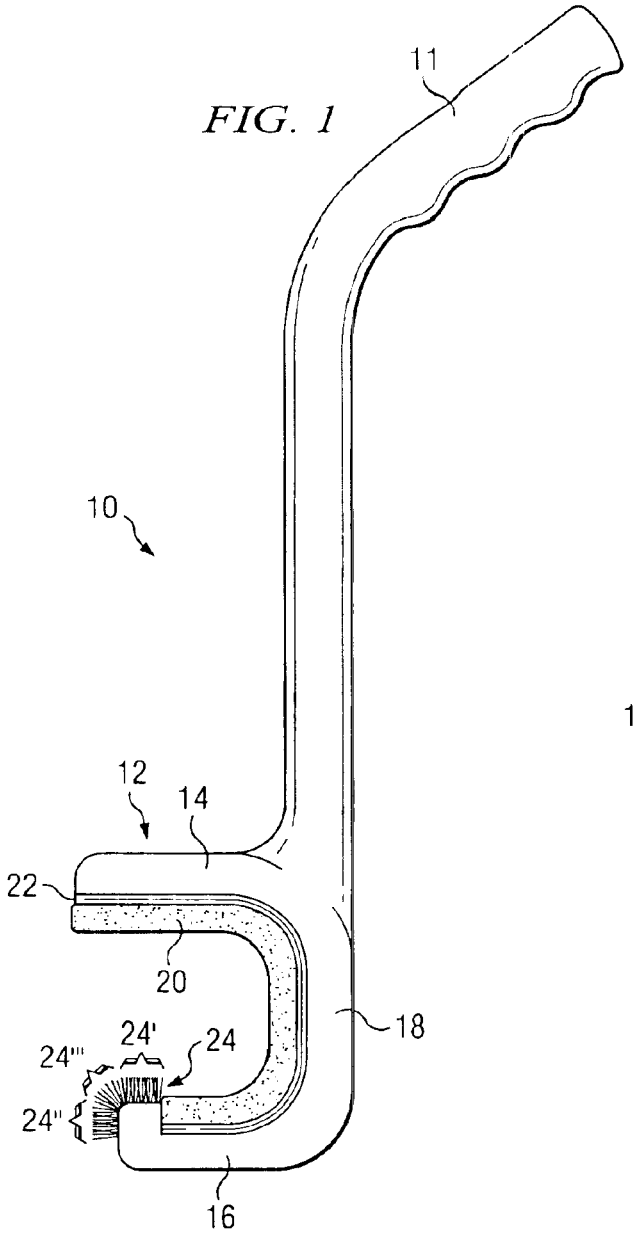
FIG. 1 is a side view of an embodiment of a toilet scrubber.
Figure 2:
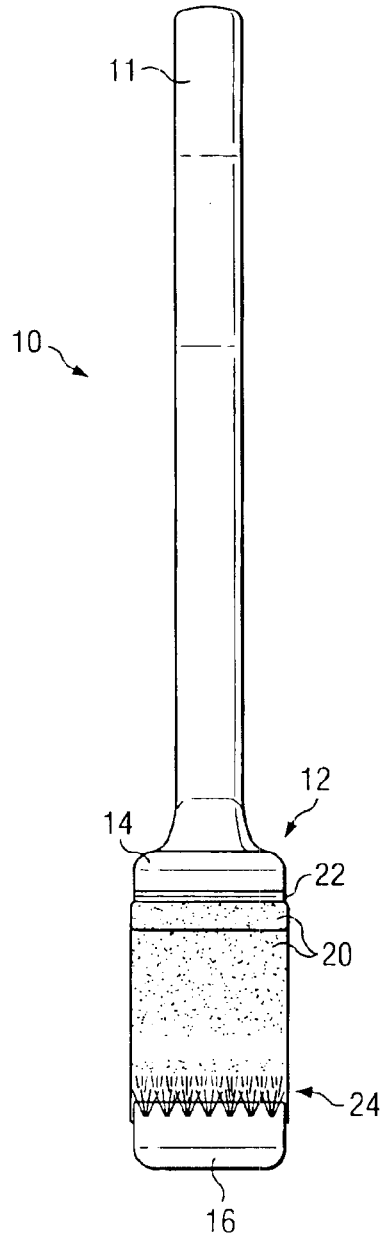
FIG. 2 is a front view of an embodiment of a toilet scrubber.
Figure 3:
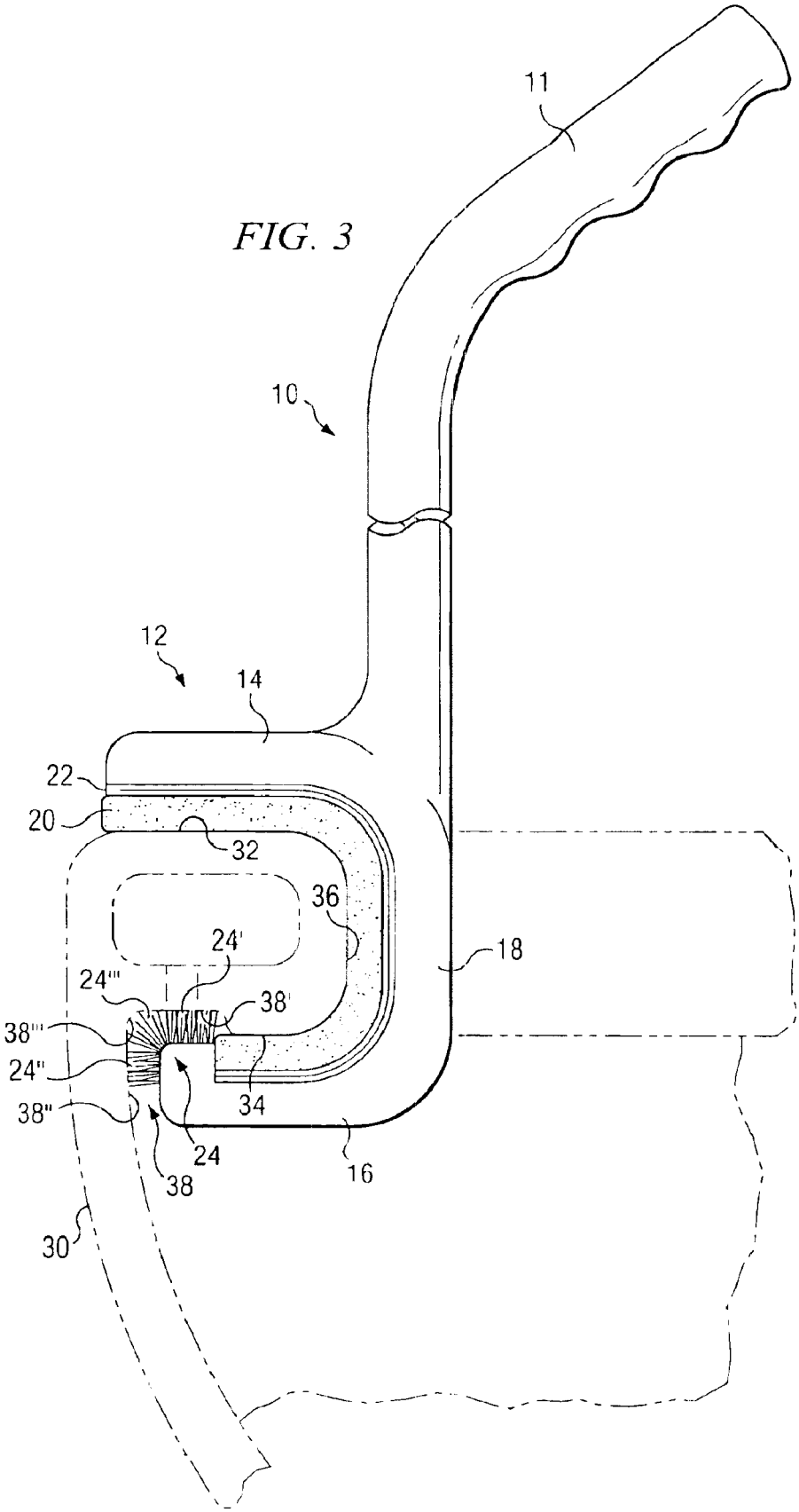
FIG. 3 is another side view of an embodiment of a toilet scrubber.

The preferred embodiment of the present invention and its advantages are best understood by referring to FIGS. 1 through 3 of the drawings.

FIG. 1 is a side view of an embodiment of a toilet scrubber 10. Toilet scrubber 10 is designed to enable a user to reach and clean substantially all surface areas of an overhanging rim of a toilet bowl with one swipe. Scrubber 10 includes a handle 11 that is preferably elongated and coupled to a scrubber head 12 at one end thereof. Handle 11 is preferably contoured and oriented to enable a user to comfortably hold handle 11 and able to apply a force onto scrubber head 12 against the toilet bowl surfaces to be cleaned. In an alternative embodiment, handle 11 may have a different configuration, such as a looped construction, that is coupled to scrubber head 12. Scrubber head 12 comprises a first arm, for example an upper arm 14; a second arm, for example a lower arm 16; and a connecting member 18 coupling upper and lower arms 14 and 16 together. In the illustrated example, scrubber head 12 is generally C-shaped or U-shaped and upper arm 14 and lower arm 16 are substantially parallel to each other. If desired, upper arm 14 and lower arm 16 may be at any angle with respect to each other. In an exemplary embodiment, upper arm 14 is longer than lower arm 16 and is configured to clean a top surface of the overhanging toilet bowl rim, as shown in more detail in FIG. 3. Lower arm 16 is operable to clean an underside surface of the overhanging toilet bowl rim, and connecting member 18 is operable to clean an inner surface of the overhanging rim. Handle 11 may be coupled to scrubber head 12 at connecting member 18 and is preferably contoured to provide a comfortable grip for a user. Further, handle 11 may have a generally curved outline with a curved upper end that enables a user to apply force more efficiently against the toilet bowl rim. Referring to FIG. 2 for a front view of toilet scrubber 10, scrubber head 12 may be constructed to provide a pleasing contour, such as egg-shaped as shown or other desirable shapes. Handle 11, upper and lower arms 14 and 16 and connecting member 18 are preferably constructed from a strong, rigid and/or resilient material such as plastic and/or wood.

A strip of scrubbing material 20 is affixed along an inner surface of upper and lower arms 14 and 16 and connecting member 18. Scrubbing material 20 may be a sponge (natural or manmade), a chamois, a paper product, a scrub pad, short bristles, and/or other absorbent and/or abrasive materials now known or later developed. Scrubbing material 20 is preferably releasably coupled to the inner surface of scrubber head 12, such as using hook and loop fasteners 22, for example. Other means of temporarily securing scrubbing material 20 to scrubber head 12 may also be employed. Scrubbing material 20 can therefore be disposed and replaced as necessary. In addition, a plurality of bristles 24 are securely attached to the end of lower arm 16 and angled upward and outward from the end of lower arm 16.

FIG. 3 is another side view of an embodiment of toilet scrubber 10. Toilet scrubber 10 is shown against the rim of a toilet bowl 30 to illustrate how the contours of scrubber head 12 fit around the toilet bowl overhanging rim and are operable to clean a plurality of surfaces thereof substantially simultaneously. Upper arm 14 is configured to clean a top surface 32 of the toilet bowl rim, connecting member 18 is configured to clean an inside surface 36 of the toilet bowl rim, and lower arm 16 is configured to clean a lower surface 34 of the toilet bowl rim. Further, bristles 24 disposed on the end of lower arm 16 are operable to reach and clean a narrow niche 38 behind the overhanging toilet bowl rim. Bristles 24' are operable to clean upper surface 38' of niche 38, bristles 24" are operable to clean side 38" of niche 38 and bristles 24'" are operable to clean area 38'" of niche 38. It may be seen that toilet scrubber 10 gives its users an efficient and tidy way to clean around the toilet bowl rim.

It may be seen that toilet scrubber 10 may be used to clean all surface areas of a toilet bowl rim in one sweeping motion around the rim. After scrubbing material 20 becomes soiled or after each use, it may be removed and replaced with fresh scrubbing material. Therefore, the user is not required to spend time or energy on cleaning the scrubbing surfaces of scrubber 10 itself, which is an unpleasant and messy chore in itself.

What is claimed is:

1. A cleaning tool, comprising:

a generally C-shaped scrubber head having an upper arm, a lower arm, and a connecting member coupling the upper and lower arms, the upper arm, lower arm and connecting member having an inner surface;

a scrubbing material releasably attached to the inner surface of the upper arm, lower arm and connecting member;

an elongated handle coupled to the scrubber head; and a plurality of short bristles disposed on a free end of the lower arm.

* * * * *